US012350563B1

(12) United States Patent
Moakes

(10) Patent No.: US 12,350,563 B1
(45) Date of Patent: Jul. 8, 2025

(54) GAME WITH A FULLY SCOREABLE OUTFIELD

(71) Applicant: Topgolf International, Inc., Dallas, TX (US)

(72) Inventor: Scott Moakes, Dallas, TX (US)

(73) Assignee: Topgolf International, Inc., Dallas, TX (US)

( * ) Notice: Subject to any disclaimer, the term of this patent is extended or adjusted under 35 U.S.C. 154(b) by 0 days.

(21) Appl. No.: 18/941,236

(22) Filed: Nov. 8, 2024

Related U.S. Application Data

(60) Provisional application No. 63/602,064, filed on Nov. 22, 2023.

(51) Int. Cl.

| | |
|---|---|
| ***A63B 67/02*** | (2006.01) |
| ***A63B 24/00*** | (2006.01) |
| ***A63B 69/36*** | (2006.01) |
| ***A63B 71/06*** | (2006.01) |

(52) U.S. Cl.
CPC ..... *A63B 67/02* (2013.01); *A63B 24/0021* (2013.01); *A63B 69/3694* (2013.01); *A63B 71/0622* (2013.01); *A63B 2024/0034* (2013.01); *A63B 2024/004* (2013.01); *A63B 2024/0096* (2013.01); *A63B 2071/0638* (2013.01); *A63B 2220/807* (2013.01); *A63B 2220/89* (2013.01)

(58) Field of Classification Search
CPC . A63B 67/02; A63B 24/0021; A63B 69/3694; A63B 71/0622; A63B 2024/0034; A63B 2024/004; A63B 2024/0096; A63B 2071/0638; A63B 2220/807; A63B 2220/89
See application file for complete search history.

(56) References Cited

U.S. PATENT DOCUMENTS

| | | | | |
|---|---|---|---|---|
| 5,298,904 | A * | 3/1994 | Olich | G01S 13/84 342/127 |
| 5,626,531 | A * | 5/1997 | Little | A63B 43/00 473/353 |
| 5,743,815 | A * | 4/1998 | Helderman | A63B 37/0003 473/353 |
| 5,910,057 | A * | 6/1999 | Quimby | A63B 43/00 473/407 |
| 6,113,504 | A * | 9/2000 | Kuesters | G01S 5/0081 473/200 |
| 6,308,160 | B1 | 10/2001 | Rex | |
| 6,634,959 | B2 * | 10/2003 | Kuesters | A63B 37/0003 473/131 |

(Continued)

OTHER PUBLICATIONS

"Topgolf Kicks off Its Summer of Play by Giving Players Even More Reasons to Come Play Around." Jun. 3, 2024. PRNewswire. Accessed Jun. 2, 2025. <https://press.topgolf.com/2024-06-03-Topgolf-Kicks-Off-Its-Summer-of-Play-by-Giving-Players-Even-More-Reasons-to-Come-Play-Around?printable> (Year: 2024).*

*Primary Examiner* — William H McCulloch, Jr.
(74) *Attorney, Agent, or Firm* — Michael A. Catania

(57) ABSTRACT

A method and system playing a game with a fully scoreable outfield at a golf entertainment venue are disclosed herein. The system includes golf ball tracking sensors, hitting bays and a server. The golf ball tracking sensors are positioned at a golf driving range. The hitting bays are also at the golf driving range, and each hitting bay has a video display. The game includes tiles that cover an entire virtual outfield of the golf driving range.

20 Claims, 17 Drawing Sheets

(56) References Cited

U.S. PATENT DOCUMENTS 6,705,942 B1 * 3/2004 Crook ..... A63B 24/0021 463/3
7,056,221 B2 6/2006 Thirkettle
7,143,639 B2 * 12/2006 Gobush ..... A63B 24/0006 73/65.03
7,160,196 B2 1/2007 Thirkettle et al.
7,337,965 B2 3/2008 Thirkettle et al.
7,636,669 B1 12/2009 Bergert
7,691,009 B2 * 4/2010 Savarese ..... A63B 37/0003 473/316
7,806,777 B2 10/2010 Cheng
7,847,808 B2 12/2010 Cheng et al.
8,002,645 B2 * 8/2011 Savarese ..... A63B 37/0003 473/409
8,077,917 B2 12/2011 Forsgren
8,270,995 B1 9/2012 Manroa et al.
8,425,350 B2 * 4/2013 Savarese ..... A63B 43/00 156/145
8,500,568 B2 * 8/2013 Bissonnette ..... A63B 69/3623 382/218
8,556,267 B2 * 10/2013 Gobush ..... A63B 71/06 273/317.2
8,758,166 B2 * 6/2014 Savarese ..... G06K 19/07758 473/353
8,784,199 B1 * 7/2014 Henrick ..... A63F 13/352 463/30
9,283,464 B2 * 3/2016 Nipper ..... A63B 24/0021
9,308,429 B1 * 4/2016 Coffman ..... A63B 24/0003
9,592,424 B2 * 3/2017 Savarese ..... H01Q 1/2225
10,300,392 B2 * 5/2019 Koo ..... A63F 13/812
10,596,416 B2 3/2020 Forsgren
10,695,646 B2 6/2020 Marten
10,799,770 B1 * 10/2020 Semsak ..... G06K 7/10425
10,898,757 B1 1/2021 Johansson et al.
11,055,885 B1 * 7/2021 Schwaiger ..... G06T 11/206
11,335,013 B2 5/2022 Forsgren et al.
11,409,411 B1 8/2022 Levin
11,446,580 B2 * 9/2022 Martin ..... A63F 13/358
11,504,582 B2 11/2022 Johansson et al.
11,513,208 B2 11/2022 Eriksson
11,557,044 B2 1/2023 Forsgren et al.
11,644,562 B2 5/2023 Hugmark et al.
11,779,809 B1 * 10/2023 Stroud ..... A63B 69/3694
11,786,783 B2 * 10/2023 Ekström ..... A63B 71/0622 473/152
11,995,846 B2 5/2024 Forsgren et al.
11,998,800 B1 * 6/2024 Stroud ..... A63B 69/3694
12,105,184 B2 10/2024 Eriksson
12,121,771 B2 10/2024 Hugmark et al.
12,128,275 B2 10/2024 Forsgren
12,246,231 B1 * 3/2025 Moakes ..... A63B 69/3694
2001/0037225 A1 11/2001 Last
2001/0045904 A1 * 11/2001 Silzer, Jr. ..... H04W 4/021 342/357.57
2002/0183872 A1 12/2002 Matsumoto et al.
2002/0188359 A1 * 12/2002 Morse ..... A63B 24/0021 700/91
2004/0142766 A1 * 7/2004 Savarese ..... A63B 37/0003 473/353
2005/0070376 A1 * 3/2005 Savarese ..... A63B 43/00 473/353
2005/0268705 A1 * 12/2005 Gobush ..... A63B 69/3658 73/65.03
2005/0272516 A1 * 12/2005 Gobush ..... A63B 71/06 473/200
2007/0167247 A1 * 7/2007 Lindsay ..... G01S 17/58 473/131
2007/0206023 A1 * 9/2007 Street ..... A63F 13/10 345/582
2009/0094072 A1 4/2009 Rodenberg
2009/0210263 A1 8/2009 Smeenge et al.
2009/0317020 A1 * 12/2009 Gerhard ..... G06T 3/4092 382/299
2011/0202376 A1 8/2011 Rodenberg
2011/0307392 A1 12/2011 Jenson
2012/0220385 A1 * 8/2012 Richardson ..... A63F 13/573 473/155
2014/0004967 A1 * 1/2014 Jang ..... G09B 9/00 473/409
2014/0004968 A1 * 1/2014 Jang ..... A63B 71/0622 473/156
2014/0004969 A1 * 1/2014 Jang ..... G06T 7/248 473/409
2014/0171167 A1 * 6/2014 Hawthorne ..... A63F 13/822 463/10
2015/0196822 A1 7/2015 Voutiliainen et al.
2016/0136502 A1 5/2016 Voutiliainen
2016/0287967 A1 * 10/2016 Baldwin ..... A63B 69/3623
2016/0354671 A1 12/2016 Nuesmeyer et al.
2016/0361617 A1 12/2016 Luciano, Jr. et al.
2017/0109660 A1 4/2017 Takuma
2017/0116548 A1 4/2017 Ito et al.
2018/0221747 A1 * 8/2018 Coffman ..... A63B 69/3661
2019/0303983 A1 10/2019 Vollbrecht et al.
2020/0108302 A1 4/2020 Marten
2020/0298124 A1 * 9/2020 Martin ..... A63F 13/52
2020/0391077 A1 12/2020 Forsgren
2021/0101069 A1 * 4/2021 Markison ..... A63F 13/577
2021/0223032 A1 * 7/2021 Suk ..... G06T 7/246
2021/0236904 A1 8/2021 Korpach
2022/0040534 A1 2/2022 Imes
2022/0203178 A1 6/2022 Burdette et al.
2022/0219062 A1 * 7/2022 Peterson ..... A63B 67/02
2022/0288479 A1 9/2022 Won
2022/0347547 A1 * 11/2022 Lucey ..... H04N 21/4781
2022/0387873 A1 * 12/2022 Hall ..... A63B 24/0021
2022/0400202 A1 * 12/2022 Imes ..... H04N 5/77
2023/0124155 A1 4/2023 Ines
2023/0196214 A1 6/2023 Cordero et al.
2023/0338801 A1 * 10/2023 Burdette ..... A63B 69/3694

* cited by examiner

100

| Shot | Launch Angle Y (Degrees) | Launch Angle X | Carry | Height | Speed | Curve | Roll | End Position |
|---|---|---|---|---|---|---|---|---|
| Drive | 10-15 | 0-2 | High | Mid/High | | **None** | Low | |
| Stinger | 5-10 | 0-1 | High | Low | | **None** | Low | |
| Chip | 25-40 | 0-1 | Low | Mid | | **Low** | High | |
| Pitch | 40-55 | 0-1 | Low | High | | **Low** | Low | |
| **Putt** | 0 | 0-2 | Low | Low | | **Low** | | **In target** |
| Bunker | | | | | | | | **In bunker** |

| Shot | Effect | Scoring | Superlative |
|---|---|---|---|
| Drive | **Sonic Boom mid flight** | Blast radius of boom activates tiles | **Aiming for the moon** |
| Stinger | **Electric ball trail** | | Electric Shot! |
| Chip | **Small Impact Bonus** | Radius of rings activated on outfield impact | **Rainmaker** |
| Pitch | **Impact Explosion** | Radius++ of rings activated on outfield impact | |
| **Putt** | Golf clap | Putting Bonus | **Drive for show, putt for dough**<br>**Tap in Master** |
| Bunker | Sandcastle Explode | Bunker Bonus | **Somebody went to the beach** |

FIG. 10

100

| Shot | Launch Angle Y (Degrees) | Launch Angle X | Carry | Height | Speed | Curve | Roll |
|---|---|---|---|---|---|---|---|
| Draw | 10-15 | -2 to -5 | | | | **Right to Left** | |
| **Fade** | 10-15 | 2 to 5 | | | | **Left to Right** | |
| **Power Fade** | 10-12 | 3 to 7 | High | | | **Left to Right** | |
| **Hook** | 8-12 | -10 -5 | | | | **Sharp left** | |
| **Slice** | 12-15 | 5 to 10 | | | | **Sharp right** | |
| **Hole-In-One** | | | | | | | |
| Target-In-One | | | | | | | |
| **Roll/Bounce into target** | | | | | | | |
| **Wormburner** | 0-1 | 1-5 | Low | Low | High | | **High** |
| **Shank** | | **>10 \|\| <-10** | | | | | |
| Near miss | | | | | | **None** | |

FIG. 11A

100

| Shot | End Position | Effect | Scoring | Superlative |
|---|---|---|---|---|
| Draw | | **Call out** | | |
| **Fade** | | **Call out** | | |
| **Power Fade** | | **Power aura ball trail** | | |
| **Hook** | | **Call out** | | |
| **Slice** | | **Call out** | | |
| **Hole-In-One** | **Middle of target, no roll** | Tile smash and AoE | Area of effect extra tiles | **Hole-in-One! ACE!** |
| Target-In-One | **Lands in target, not center, no roll** | Tile smash and AoE | Area of effect extra tiles | |
| **Roll/Bounce into target** | **Lands near outfield - rolls/bounces into target** | Skipping stone, rays from below | Area of effect extra tiles | |
| **Wormburner** | | **Fire trail** | Extra tiles activated by bounce and roll | |
| **Shank** | | **Call out** | | Air mail<br>Fore!<br>Whiff Wizard |
| Near miss | **Left or Right of a target** | Slow motion - Call out - "Aaaaaw" | | |

FIG. 11B

200

| Shot Type | Description | Key Flight Characteristics | Detect-able? |
|---|---|---|---|
| **Drive** | The first shot on a hole, typically made from the tee box with a driver to cover as much distance as possible. | High launch angle, long carry distance, and typically low curve. | Yes |
| **Approach** | Usually the second shot on a hole with the goal of landing the ball on the green. | Medium launch angle, targeted distance (depending on hole distance), and minor curve (if aiming for a draw or fade). | Maybe |
| **Tee Shot** | Any shot taken from the tee box to start a new hole. | Depends on the club used, could vary from high launch and distance (driver) to lower launch and distance (iron or wood). | No* |
| **Chip** | A less powerful, short game shot where the ball spends more time on the ground than in the air. | Low launch angle, short carry distance, and the ball spends more time rolling on the ground. | Yes |
| **Pitch** | Similar to a chip but hit with a higher trajectory; the ball spends more time in the air than on the ground. | Higher launch angle than chip shot, short carry distance, and the ball spends more time in the air. | Yes |
| **Putt** | A precise shot performed on the green with a putter, aimed at getting the ball into the hole. | Very low launch angle (almost zero), very short carry distance, and ball spends almost all its time rolling. | Yes |
| **Bunker (Sand) Shot** | A shot hit from a sand bunker using a sand wedge to hit the sand behind the ball. | High launch angle, short distance, typically a lot of backspin. | Yes |
| **Flop Shot** | A high trajectory shot usually hit over a hazard or bunker, designed to stop quickly once it lands. | Very high launch angle, short distance, maximum height, and often high backspin. | Yes |
| **Punch (Knockdown) Shot** | A low trajectory shot designed to avoid wind or go under tree branches. | Very low launch angle, less carry distance than a normal shot with the same club. | Yes |

*all shots are Tee Shots

FIG. 12

200

| | | | |
|---|---|---|---|
| **Draw** | A shot that, for a right-handed golfer, curves gently from right to left. | Starts right of the target and gently curves left (for a right-handed golfer), has topspin. | Yes |
| **Fade** | The opposite of a draw; for a right-handed golfer, it curves gently from left to right. | Starts left of the target and gently curves right (for a right-handed golfer), has backspin. | Yes |
| **Hook** | A shot that curves sharply from right to left (for a right-handed golfer). | Starts right of the target and curves sharply left (for a right-handed golfer), increased topspin. | Yes |
| **Slice** | A shot that curves sharply from left to right (for a right-handed golfer). | Starts left of the target and curves sharply right (for a right-handed golfer), increased backspin. | Yes |
| **Lay-up Shot** | This shot is hit with the aim of positioning the ball for the next shot, often played when reaching the green or target in one shot is not possible or practical. | Controlled distance, often less than the full potential of the club used. | No |
| **Recovery (or Escape) Shot** | This shot is played to get the ball back into a good position when it has ended up in a difficult spot, like deep rough, bushes, or trees. | Variable flight characteristics depending on the situation. Often lower than normal launch angle if escaping from under trees. | No |
| **Pitch-and-Run** | A shot hit from a sand bunker using a sand wedge to hit the sand behind the ball. | Combination of a pitch's launch angle with the ground roll of a chip shot. | Yes |
| **Hole-In-One** | Shot straight from Tee into a target | | Yes |

FIG. 13

300

| Shot Type | Description | Key Flight Characteristics | Detect-able? |
|---|---|---|---|
| Wormburner | This is a shot that travels very low to the ground, almost as if it's "burning worms." | Extremely low launch angle, the ball skims along the ground. | Yes |
| Skull | A shot where the club hits the top half of the ball, causing it to shoot forward with a low trajectory. | Low launch angle, potentially high speed, ball is hit with the leading edge of the club. | Maybe |
| Shank | A dreaded type of shot where the ball is struck with the hosel (part of the club where the head and shaft connect), causing it to veer off at a sharp angle. | Ball flies sharply to the right (for right- handed golfers), as it's struck with the hosel of the club. | Yes |
| Duff | A poorly hit shot where the golfer hits the ground before the ball, often causing the ball to travel a much shorter distance than intended. | Very short carry distance, club hits ground before the ball. | Maybe |
| Chunk | A shot occurs when the club hits the ground before the ball, causing the ball to come up short of the target. | Very short carry distance, club digs into turf before striking ball. | No |
| Thin (or Bladed) Shot | This shot happens when the ball is hit with the bottom edge or "blade" of the club. | Low launch angle, ball is struck with the bottom edge of the clubface. | No |
| Fat Shot | When the club hits the ground before making contact with the ball. | Very short carry distance, club hits ground well before the ball. | No |
| Pop Shot | This shot occurs when the club strikes the ball too high, causing it to pop up into the air and not travel very far. | Extremely high launch angle but short carry distance, ball is struck too high on the clubface. | Yes |

FIG. 14

300

| | | | |
|---|---|---|---|
| Flush | This refers to a well-struck shot where the ball is hit squarely with the center of the clubface. | Optimal launch angle and carry distance, ball is struck in the center of the club-face. | Yes |
| Snap Hook | This shot starts right of the target (for a right-handed golfer) and then curves violently to the left. | Starts right of the target and then curves violently to the left (for a right- handed golfer). | Yes |
| Pull | This is a shot that flies straight but to the left of the target (for a right-handed golfer). | Ball flies straight but to the left of the target (for a right-handed golfer). | Yes |
| Push | This is a shot that flies straight but to the right of the target (for a right-handed golfer). | Ball flies straight but to the right of the target (for a right-handed golfer). | Yes |
| Blocked Shot | This is a shot that goes directly to the right (for a right-handed golfer), often caused by an outside-to-inside swing path that "blocks" the clubface from turning and squaring to the target. | Ball goes directly to the right (for a right-handed golfer), caused by an outside-to-inside swing path and squaring to the target. | Yes |

FIG. 15

GAME WITH A FULLY SCOREABLE OUTFIELD

CROSS REFERENCES TO RELATED APPLICATIONS

The Present Application claims priority to U.S. Patent Application No. 63/602,064, filed on Nov. 22, 2023, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to games utilizing physical and virtual elements.

Description of the Related Art

To score points in current TOPGOLF games, players are required to drive a golf ball from their bay and hit either a real-world target or virtual target provided by the game. This causes problems for some players who cannot hit those targets. When this occurs, the player doesn't score any points and is unable to compete with others in their bay who can hit the targets. This results in a negative experience for the player, which should be resolved.

BRIEF SUMMARY OF THE INVENTION

The solution should ensure players who are unable to hit their golf ball into a target in the outfield can still obtain points and feel like they can still compete with other players.

The present invention provides a system and method for playing a game with a fully scoreable outfield at a golf entertainment venue.

One aspect of the present invention is a system for playing a game with a fully scoreable outfield at a golf entertainment venue. The system comprises of golf ball tracking sensors positioned at a golf driving range, hitting bays at the golf driving range with each of the hitting bays having a video display, and a server which is in communication with each of the golf ball tracking sensors and with each video display.

In this system the server generates a game on the video display. The game's virtual outfield comprised of tiles represents the actual golf driving range at which the game is played. A player hits a golf ball from a hitting bay and the ball is tracked by sensors. Wherever the ball impacts the outfield, the player is awarded points for virtually hitting the tiles.

Another aspect of the present invention is a method for playing a game with a fully scoreable outfield at a golf entertainment venue. The method comprises generating a game on a video display of a hitting bay; hitting a golf ball into the outfield from the hitting bay; tracking the flight of the golf ball by tracking sensors; communicating the tracked flight data from the sensors to the server; generating a bounce and roll prediction for the tracked golf ball; combining the flight data and the prediction to generate a complete shot of the golf ball in the game; displaying the full shot of the golf ball in the virtual outfield on the video display in the hitting bay; and awarding points for the tiles impacted by the golf ball in the full shot.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 10 is a table of shot types.

FIG. 11A is a continuation of the table of FIG. 10.

FIG. 11B is a continuation of the table of FIG. 11A.

FIG. 12 is a table of formal shot types.

FIG. 13 is a continuation of the table of FIG. 12.

FIG. 14 is a table of informal shot types.

FIG. 15 is a continuation of the table of FIG. 14.

DETAILED DESCRIPTION OF THE INVENTION

Figure 1:
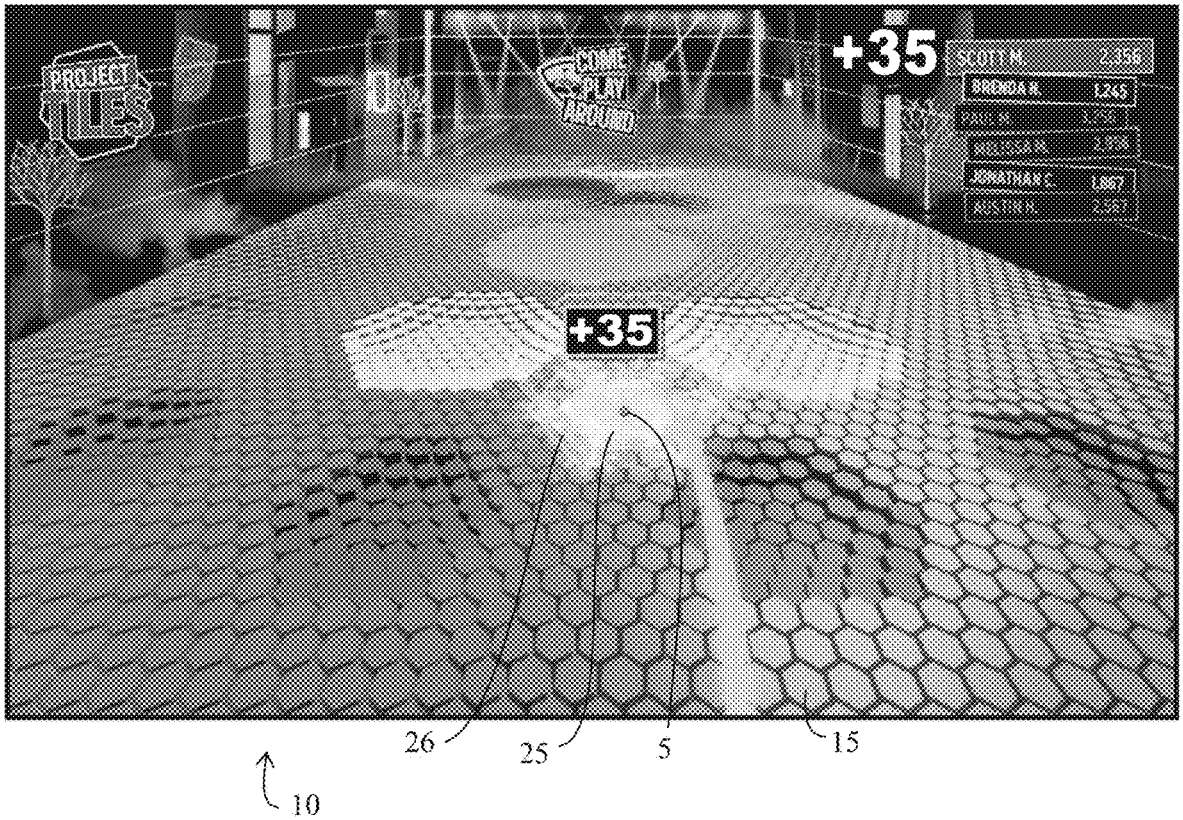
FIG. 1 is a screen shot of the virtual display of the golf range when playing the game.

At a golf entertainment venue, a player or group of players are assigned a hitting bay. The hitting bay has various screens and graphical user interfaces for inputting player information and selecting a game to play. The hitting bay also has a golf ball dispenser with a screen such as disclosed in Burdette et al., U.S. Patent Publication Number 20220203178 (U.S. patent application Ser. No. 17/699,020 filed on Mar. 18, 2022) for a Golf Ball Dispenser With Embedded Display Device, Separate Front Waterfall Panel And/Or Blower Assembly, which is hereby incorporated by reference in its entirety. When a game with a reactive function is selected by a player, the game begins to track the players performance for each shot. This involves obtaining golf ball tracking data and utilizing a game engine with a virtual game. The golf ball tracking data is combined with the virtual game data to generate an output displayed on the various screens in the hitting bay and on devices. When a ball is hit, a camera system tracks the ball flights and produces a trace data for the struck golf ball. Such a system is disclosed in Hugmark et al., U.S. Pat. No. 12,121,771 for a Trajectory Extrapolation And Origin Determination For Objects Tracked in Flight, which is hereby incorporated by reference in its entirety. The virtual environment for a game is provided for combining the data with the golf ball tracking data. One such mechanism for providing data to generate a virtual environment for a driving range of a golf entertainment venue is disclosed in Medcalf, U.S. patent application Ser. No. 18/751,522, filed on Jun. 24, 2024, for Data Generated Outfields, is hereby incorporated by reference in its entirety. Generating a virtual image of a driving range of golf entertainment venue is also disclosed in Cheng et al., U.S. Pat. No. 7,847,808 for Photographic Mapping In A Simulation, which is hereby incorporated by reference in its entirety. Thus the playing field for a game is constructed in in a virtual environment creating a virtual driving range that matches the X-Y coordinates of the physical driving range. Further, use of virtual golf equipment is disclosed in Cheng, U.S. Pat. No. 7,806,777 for Automatically Adapting Virtual Equipment Model, which is hereby incorporated by reference in its entirety. Further, the bounce and the roll of a golf ball in a virtual environment is disclosed in Medcalf, U.S. patent application Ser. No. 18/750,251, filed on Jun. 21, 2024, for a Bounce & Roll Engine, is hereby incorporated by reference in its entirety.

Bespoke software components (BSC) should: determine where the golf ball has impacted the outfield; and award points, whether the ball hits a target or not.

This will allow for the following benefits to the games: allows scoring for a wider range of skill levels; variety—not always having to aim for the regular targets; different golf strategies—players have more opportunity to play it safe or take bigger risks, utilizing the entire outfield for scoring.

Covering the outfield in hexagonal tiles allows for giving the player points based on where the ball lands and rolls with the need to hit a target. However, each tile can alternatively be a square, circle, diamond, triangle, rectangle or polygon.

Each tile is preferably the same size. Each tile has a representative width ranging from 0.1 meter to 10 meters in the virtual outfield.

On game load, the data for the current venue in which the game is being played is pulled into the game and the regular outfield 10 is generated from it.

Figure 3:
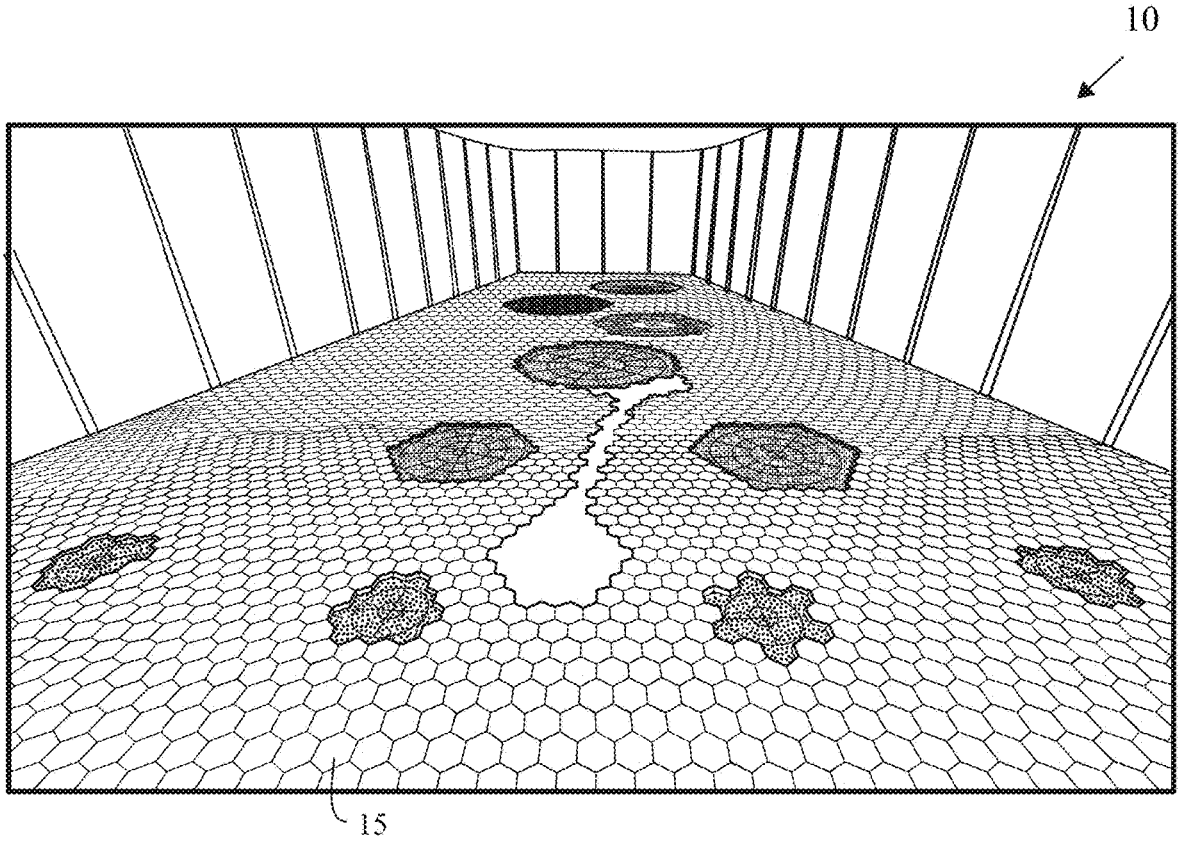
FIG. 3 is an illustration of the virtual display of the golf range when playing the game.
Figure 4:
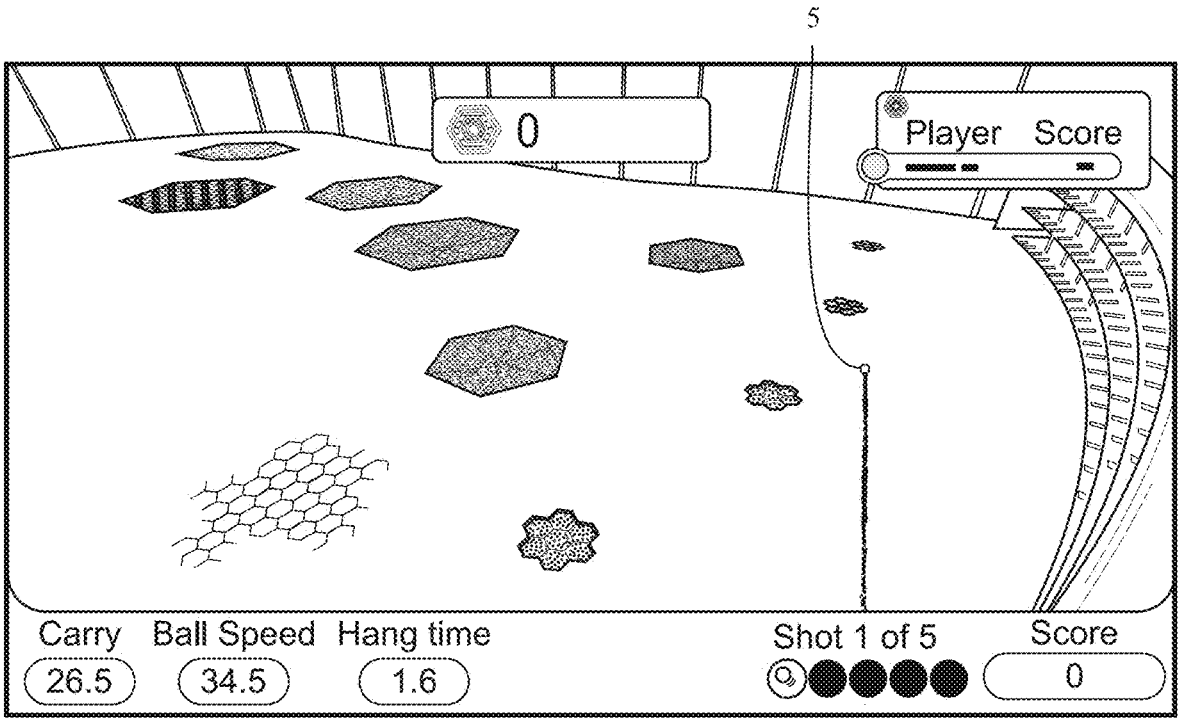
FIG. 4 is an illustration of the virtual display of the golf range when playing the game.
Figure 5:
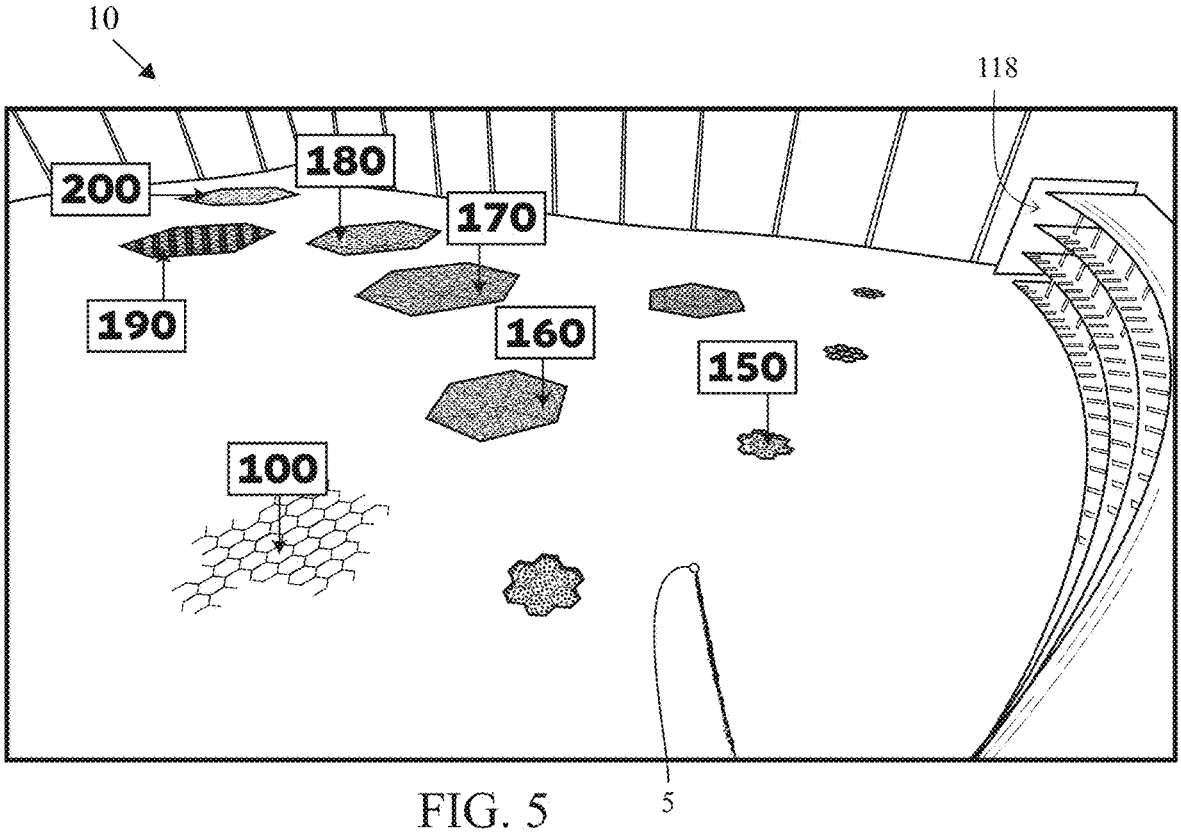
FIG. 5 is an illustration of the virtual display of the golf range when playing the game.
Figure 8:
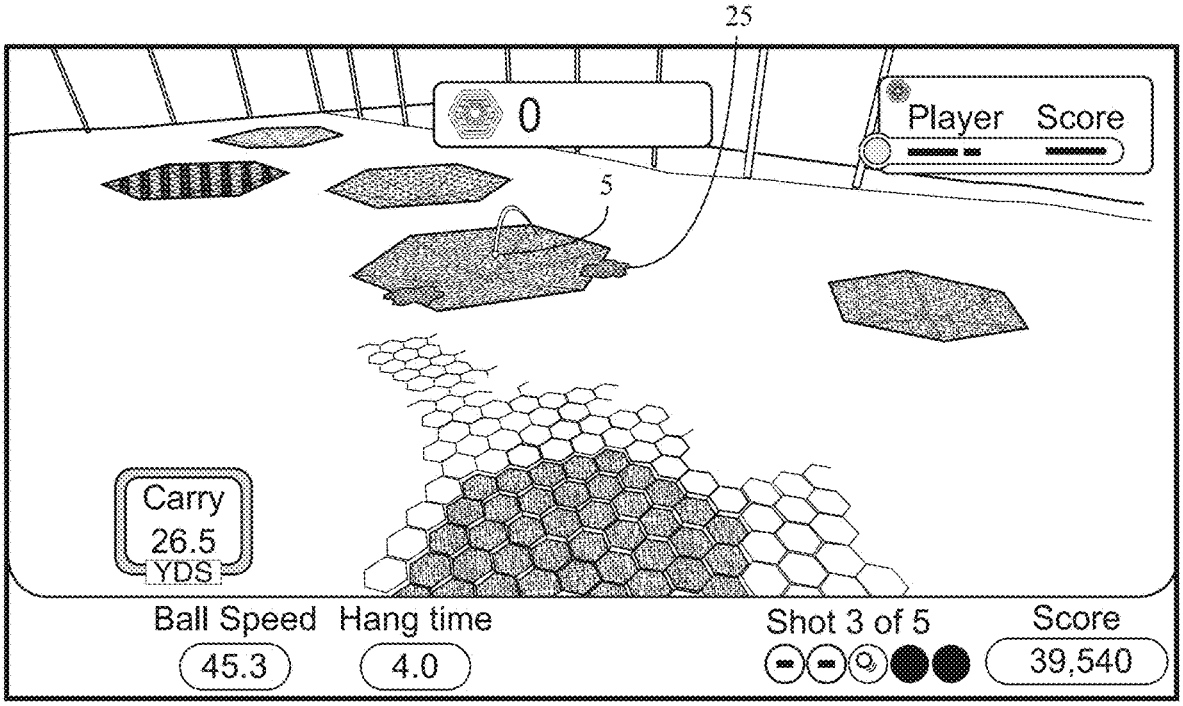
FIG. 8 is an illustration of the virtual display of the golf range when playing the game.

The BSC then creates a grid of hexagonal tiles 15, overlaying them on the generated outfield. A tile-covered outfield 10 can be seen in FIGS. 1-3. In FIGS. 4-5 and FIG. 8 the outfields have the same tile layout, however, only a patch of tiles is shown as an example.

Preferably, the number of tiles the grid is comprised of is between 100 to 100,000 tiles. More preferably, the grid is comprised of 1,000 to 50,000 tiles. Even more preferably, the grid is comprised of 10,000 to 20,000 tiles.

A player's golf ball 5 is tracked by sensors and when the player's golf ball 5 impacts with the outfield 10, the BSC checks the impact position and finds the nearest tile in the grid created. Then that tile is activated and points are awarded to the player for hitting that tile.

Figure 6:
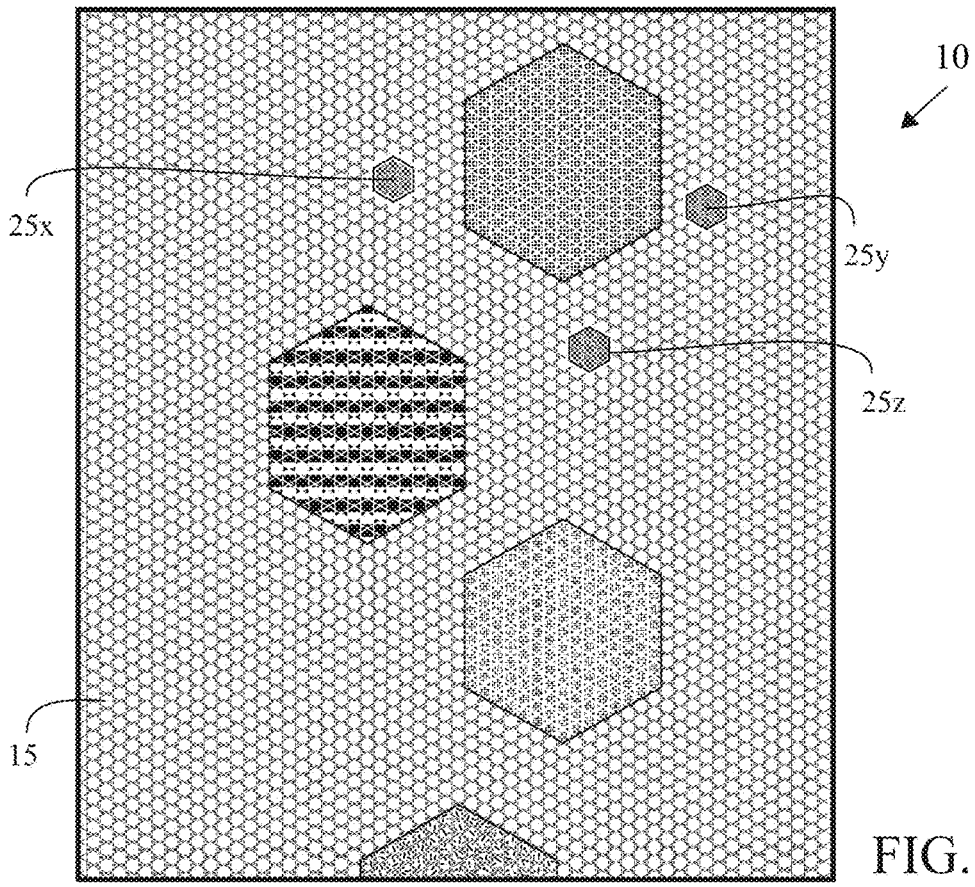
FIG. 6 is an illustration of an isolated portion of the virtual display of the golf range when playing the game.
Figure 7:
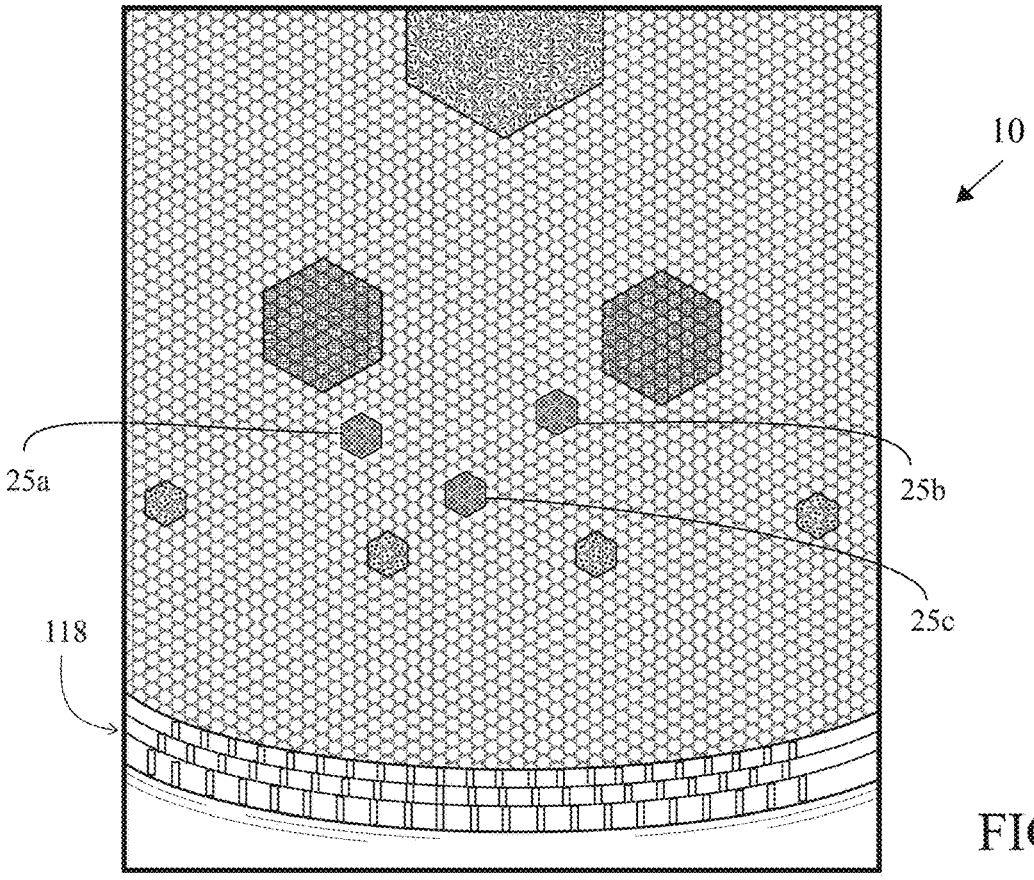
FIG. 7 is an illustration of an isolated portion of the virtual display of the golf range when playing the game.

As play progresses, bonus tiles 25, shown in FIGS. 6-8, appear in the outfield 10, glowing and highlighted so that the player knows something great will happen if the player hits one. Hitting a bonus tile 25 activates surrounding tiles and awards the player with extra points.

The placement of bonus tiles 25 adjusts to how the player has been hitting their shots. To achieve this, the player's shot history during the game is used to determine the placement of bonus tiles 25. This means that the more skilled golfers who are hitting the ball further down the outfield 10 will have more difficult bonus tiles 25 to hit. Players hitting the ball closer to the hitting bays 118 will get much easier bonus tiles to hit, making it easier for them to score points. FIG. 7 shows a short shot player's bonus tile 25*a*-25*c* placement versus a long shot player's bonus tile 25*x*-25*z* placement in FIG. 6.

FIGS. 1-5 show screen shots of the outfield 10 of the game while playing.

Figure 9:
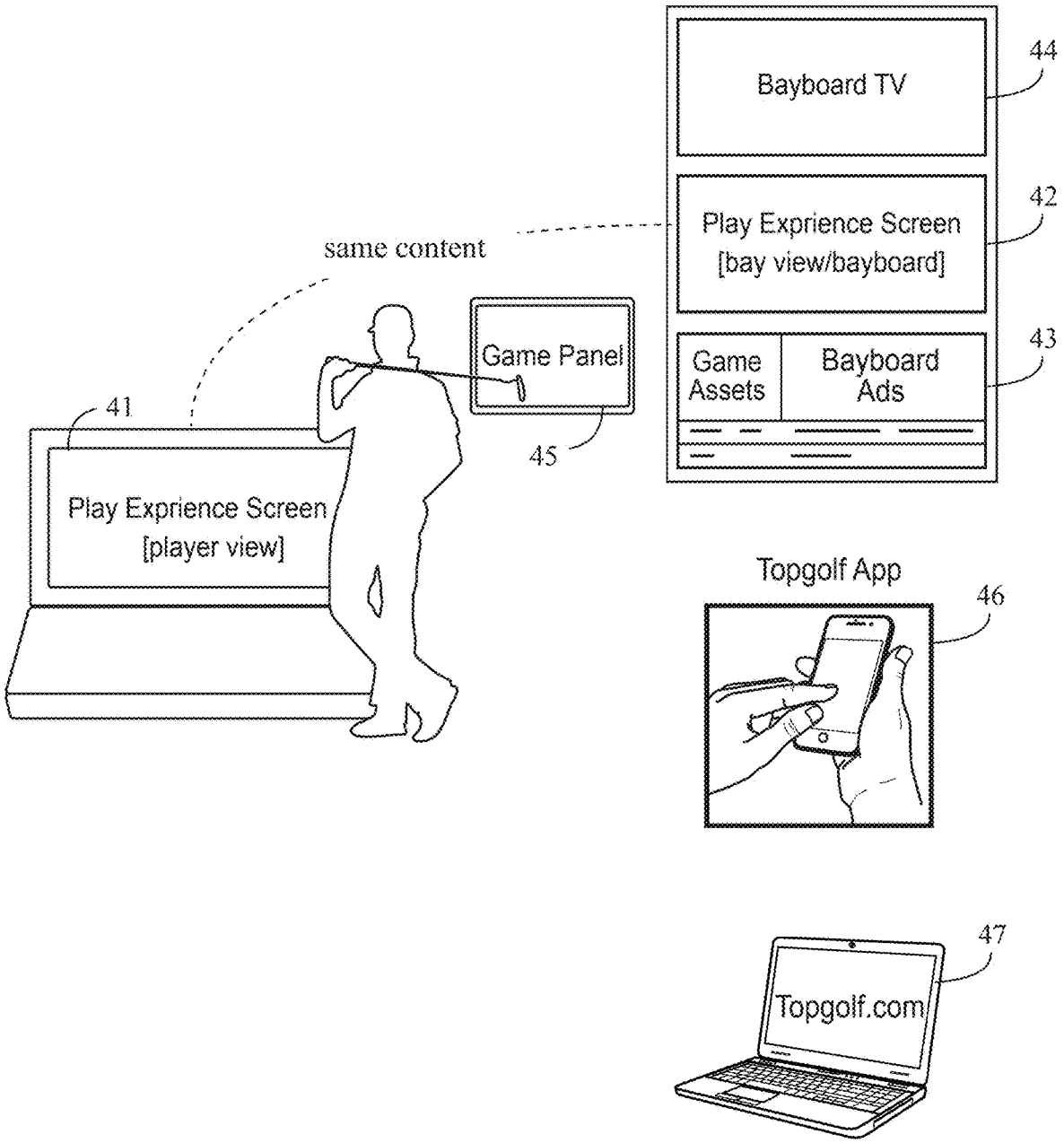
FIG. 9 is an illustration of player interfaces and venue screens.

FIG. 9 is an illustration of the different player interfaces and venue screens. The play experience screens show the same content in the hitting bay. The player view screen 41 is front of the player as the player addresses the golf ball. The game panel 45 allows the player to make adjusts to the player order and to input additional information. The bay view screen 42 displays the same content as the player view screen. A bayboard TV 44 provides additional content to the players in the hitting bay, and bayboard ads 43 displays various advertising content to the players in the hitting bay. The game can be also viewed through a mobile app 46 or through a website 47 of the venue.

FIG. 10 is a table 100 of shot types and their details relating to the game. The shot types are: drive, stinger, chip, pitch, putt, and bunker. The top table data is mainly used for determining the shot type. The Effect, Scoring and Superlatives are reactions to the shot type and used in-game to award points for virtually hitting tiles and to make game playing more positive.

An example of a shot type and the resulting details is shown in FIG. 1. A player hit a ball 5 onto a bonus tile 25. From the shot characteristics gathered by the system, it was determined that it was a pitch shot. For the pitch shot, in the bottom table 100, the Effect is an impact explosion and the Scoring is a radius++ of rings activated on outfield impact 26.

Figure 2:
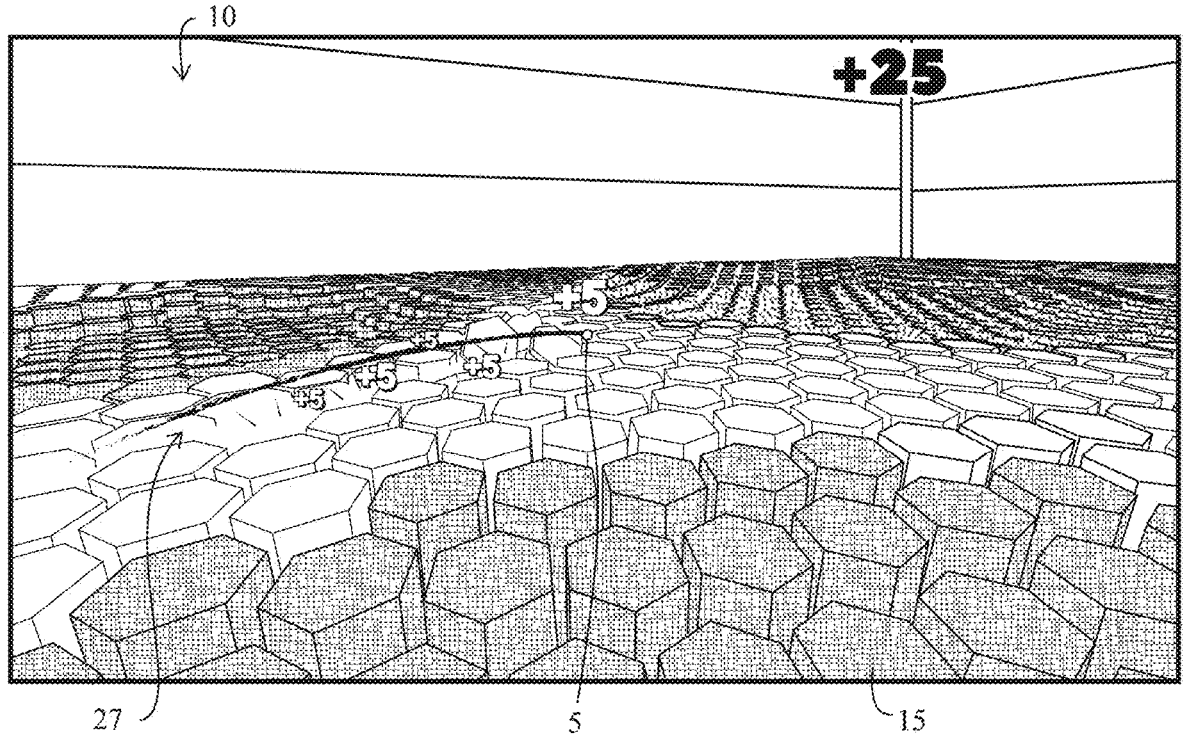
FIG. 2 is an illustration of an isolated portion of the virtual display of the golf range when playing the game.

FIG. 11A is a continuation of the table 100 of shot types and their details. The shot types here are draw, fade, power fade, hook, slice, hole-in-one, target-in-one, roll/bounce into target, wormburner, shank and near miss. FIG. 11B is a continuation of the details of the shot types in FIG. 11A. For the roll/bounce shot the skipping stone and rays from below 27 are shown in FIG. 2. The extra tiles were 5 points each, thereby awarding a bonus of 25 total points.

FIGS. 12-13 show a table 200 of formal shots describing their characteristics and their detectability. The formal shots are: drive; approach; tee shot (all shots are considered tee shots); chip; pitch; putt; bunker (sand) shot; flop shot; and punch (knockdown) shot; draw; fade; hook; slice; layup shot; recovery/escape shot; pitch-and-run; and a hole-in-one.

FIGS. 14-15 show a table 300 of informal shots describing their characteristics and their detectability. The unformal shots are wormburner; skull; shank; duff; chunk; thin/bladed shot; fat shot; pop shot; flush; snap hook; pull; push; and blocked shot.

Figure 16:
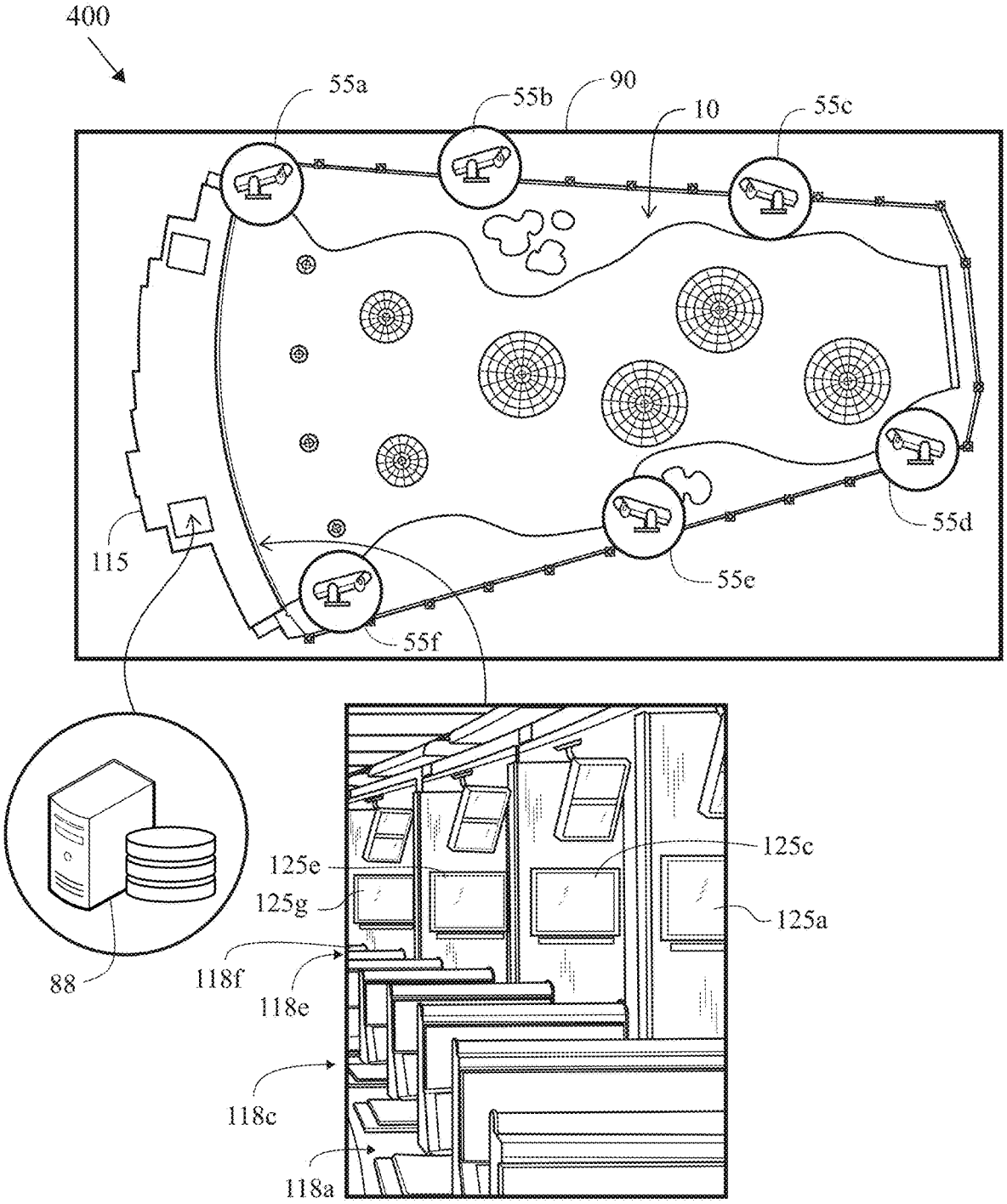
FIG. 16 is an illustration of a system for playing a player reactive game at a golf entertainment venue.

A system 400 for playing a game with a fully scoreable outfield at a golf entertainment venue 90 is shown in FIG. 16. The system includes golf ball tracking sensors 55*a*-55*f* positioned at the driving range, hitting bays 118 with a video display 125 in each bay 118, and a server 88. The server 88 communicates with each of the golf ball tracking sensors 55*a*-55*f* and with each video display 125*a*-125*e* of the hitting bays 118*a*-118*f*. The server 88 generates a game on the video display. The game is: a player hits a golf ball, which is tracked by at least two tracking sensors, from a hitting bay; the entire virtual outfield of the golf driving range is made up of tiles; the player is awarded points for virtually hitting tiles.

The golf ball tracking sensors 55 are preferably camera sensors. Alternatively, they can be radar sensors.

Figure 17:
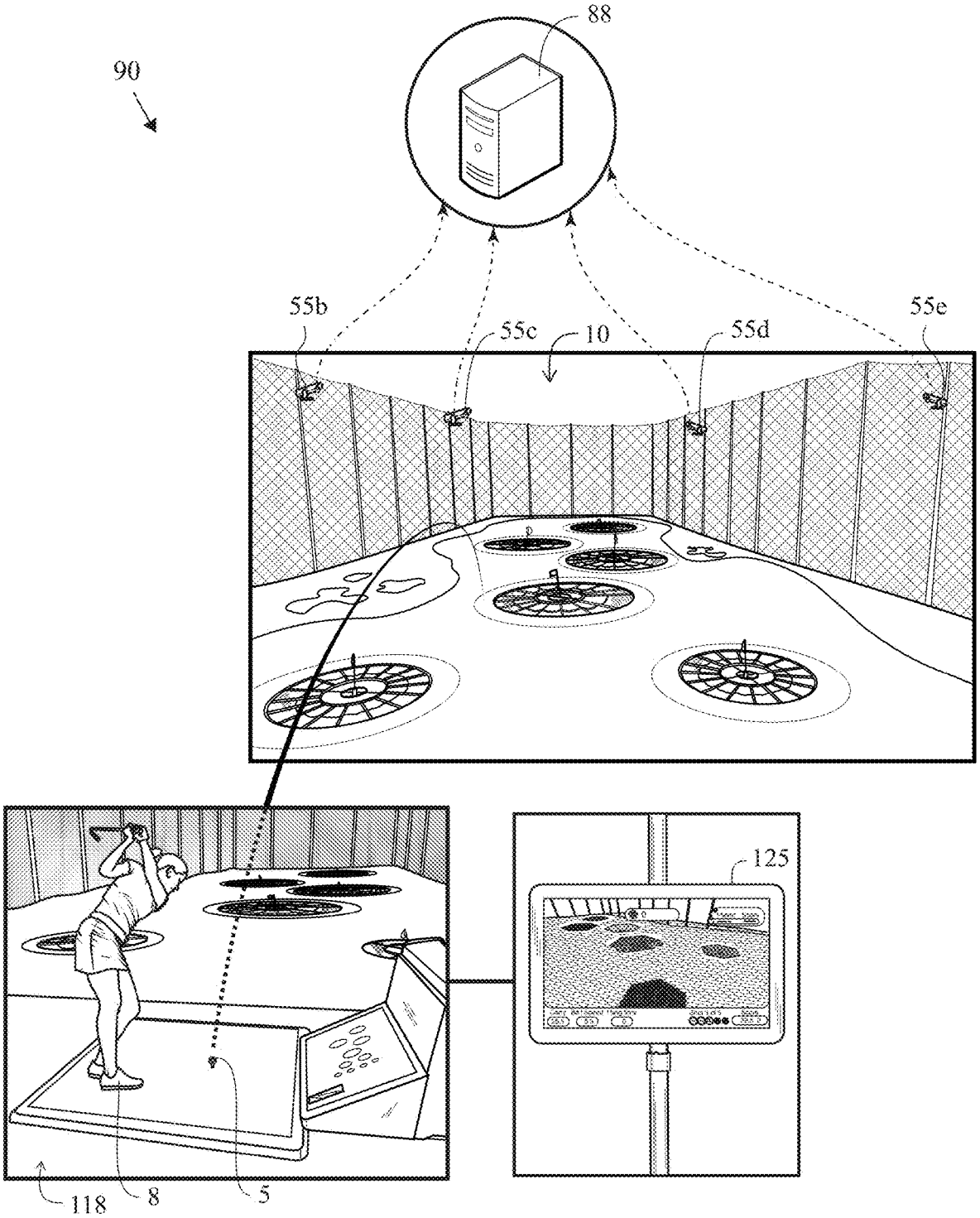
FIG. 17 is an illustration of a golf entertainment venue.

A golf entertainment venue 90 is shown in FIG. 17. In reference to FIG. 16, the hitting bays 118 are in the building 115 portion of the venue 90, facing the outfield 10. Within each hitting bay 118, there is a video display 125 from which a player plays the game. A ball 5 hit by a player 8 while playing the game is tracked by golf ball tracking sensors 55. Preferably, at least two or more sensors. The player 8 is awarded with points for hitting virtual tiles, shown on the display 125.

Figure 18:
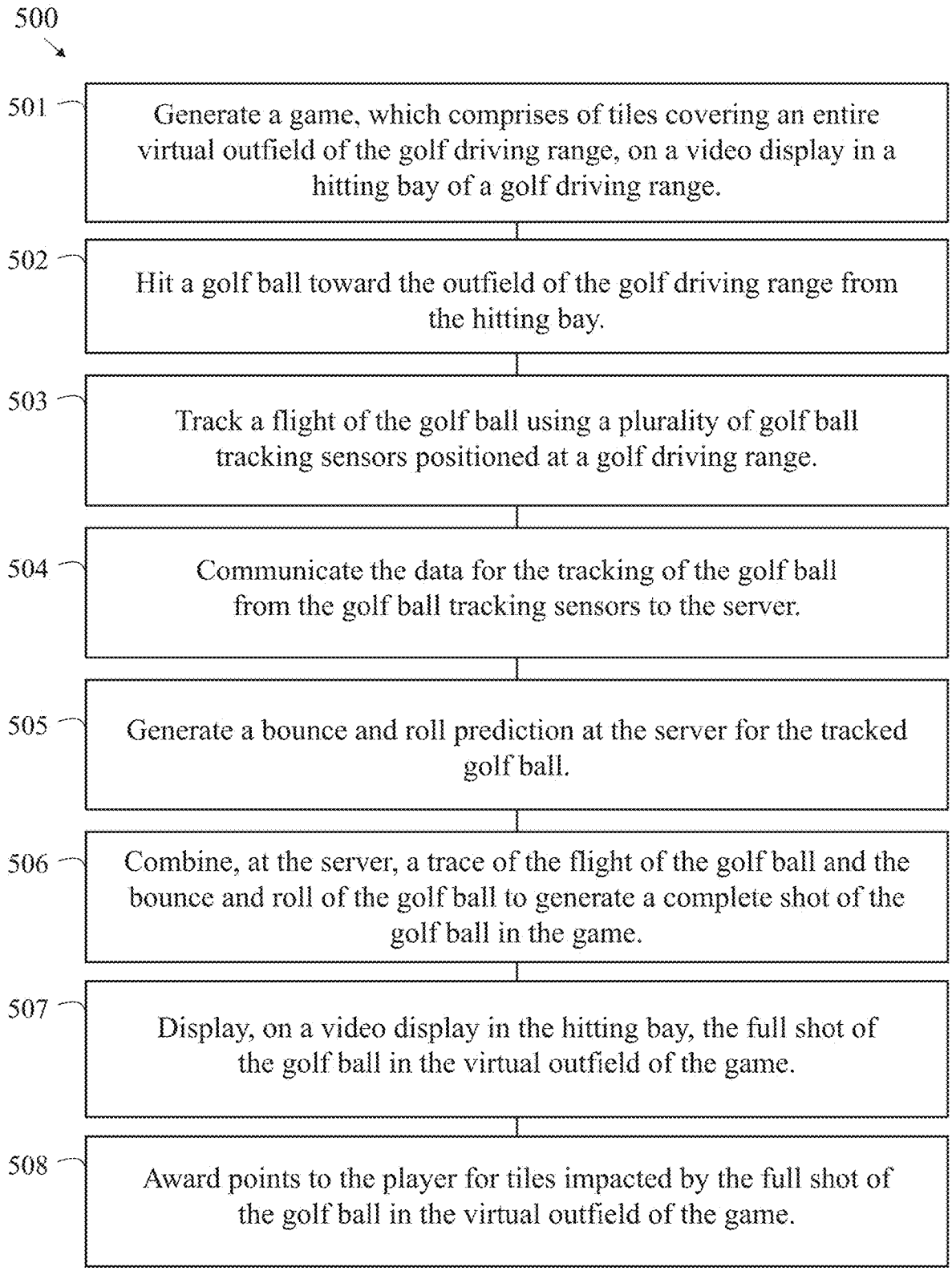
FIG. 18 is a flow chart for a method for playing a player reactive game at a golf entertainment venue.

A flow chart 500 for a method for playing a game with a fully scoreable outfield at a golf entertainment venue is shown in FIG. 18. In step 501, a game, created by tiles covering an entire virtual outfield of the golf driving range, is generated on a video display in a hitting bay. A player, from the hitting bay, hits a golf ball towards the outfield of the driving range in step 502. The flight of each golf ball shot is tracked by the tracking sensors in step 503. The data for the tracked golf ball is sent from the tracking sensors to the server in step 504. In step 505, a bounce and roll prediction is generated at the server for the tracked golf ball. In step 506, at the server, a trace of the flight of the golf ball and the bounce and roll of the golf ball is combined to generate a complete shot of the golf ball in the game. In step 507, the full shot of the golf ball in the virtual outfield of the game is shown on the video display. Step 508 is awarding points to the player for the tiles impacted by the golf ball shot in the virtual outfield of the game.

The BSC allows for custom point values to be assigned to a tile to award more/less points depending on where the ball lands.

Thirkettle et al., U.S. Pat. No. 7,056,221 for a Ball Collection Arrangement, is hereby incorporated by reference in its entirety.

Golliffe et al., U.S. Pat. No. 7,059,974 for Golf Balls With Impact Resistant Identification Device, is hereby incorporated by reference in its entirety.

Thirkettle et al., U.S. Pat. No. 7,160,196 for an Identification Device, is hereby incorporated by reference in its entirety.

Thirkettle et al., U.S. Pat. No. 7,337,965 for a Ball Identifying Device, is hereby incorporated by reference in its entirety.

Savarese et al., U.S. Pat. No. 7,691,009 for Apparatus And Methods Relating To Findable Balls, is hereby incorporated by reference in its entirety.

Savarese et al., U.S. Pat. No. 7,766,766 for Methods And Apparatus Relating To Findable Balls, is hereby incorporated by reference in its entirety.

Cheng, U.S. Pat. No. 7,806,777 for Automatically Adapting Virtual Equipment Model, is hereby incorporated by reference in its entirety.

Cheng, U.S. Pat. No. 7,847,808 for Photographic Mapping In A Simulation, is hereby incorporated by reference in its entirety.

Savarese et al., U.S. Pat. No. 8,002,645 for Apparatus, Methods And Systems Relating To Findable Balls, is hereby incorporated by reference in its entirety.

Cheng, U.S. Pat. No. 8,029,359 for Providing Offers To Computer Game Players, is hereby incorporated by reference in its entirety.

Forsgren, U.S. Pat. No. 8,077,917 for Systems And Methods For Enhancing Images in A Video Recording of A Sports Event, is hereby incorporated by reference in its entirety.

Caster et al., U.S. Pat. No. 9,132,326 for a System For Providing Loaner Clubs To Novice Golfers, is hereby incorporated by reference in its entirety.

Forsgren, U.S. Pat. No. 10,596,416 for a System And Method For Three Dimensional Object Tracking Using Combination of Radar And Image Data, is hereby incorporated by reference in its entirety.

Semsak et al., U.S. Pat. No. 10,799,770 for a RFID Golf Ball Testing Apparatus, is hereby incorporated by reference in its entirety.

Johanssson et al., U.S. Pat. No. 10,898,757 for Three Dimensional Object Tracking Using Combination of Radar Speed Data And Two Dimensional Image Data, is hereby incorporated by reference in its entirety.

Forsgren et al., U.S. Pat. No. 11,335,013 for Three Motion Based Pre-Processing Of Two-Dimensional Image Data Prior To Three-Dimensional Object Tracking With Virtual Time Synchronization, is hereby incorporated by reference in its entirety.

Levin, U.S. Pat. No. 11,409,411 for a Single Finger User Interface Camera Control, is hereby incorporated by reference in its entirety.

Johansson et al., U.S. Pat. No. 11,504,582 for Three Dimensional Object Tracking Using Combination of Radar Speed Data And Two Dimensional Image Data, is hereby incorporated by reference in its entirety.

Stroud, U.S. Pat. No. 11,779,809, for a Method And System Utilizing A Golf Shot API Proxy, is hereby incorporated by reference in its entirety.

Burdette, U.S. patent application Ser. No. 18/202,178, filed on May 25, 2023, for a Golf Ball Identification Apparatus And System, is hereby incorporated by reference in its entirety.

Burdette et al., U.S. Patent Publication Number 20220203178, for a Golf Ball Dispenser With Embedded Display Device, Separate Front waterfall And/Or Blower Assembly, is hereby incorporated by reference in its entirety.

Ekstrom et al., U.S. Pat. No. 11,786,783 for Identifying A Location For A Striker Of An Object, is hereby incorporated by reference in its entirety.

Eriksson et al., U.S. Pat. No. 11,815,618 for Doppler Radar Coexistence, is hereby incorporated by reference in its entirety.

Wase, U.S. Pat. No. 11,934,085 for a Camera Mounting Post, is hereby incorporated by reference in its entirety.

Burdette et al., U.S. Pat. No. 11,944,883, for a Galton Configuration In Golf Ball Receiving Apparatus And Systems, is hereby incorporated by reference in its entirety.

Forsgren et al, U.S. Pat. No. 11,995,846 for Three Dimensional Object Tracking Using Unverified Detections Registered By One Or More Sensors, is hereby incorporated by reference in its entirety.

Medcalf, U.S. patent application Ser. No. 18/750,683, filed on Jun. 21, 2024, for a RFID And Trace Pairing, is hereby incorporated by reference in its entirety.

Medcalf, U.S. patent application Ser. No. 18/751,522, filed on Jun. 24, 2024, for Data Generated Outfields, is hereby incorporated by reference in its entirety.

Medcalf, U.S. patent application Ser. No. 18/750,251, filed on Jun. 21, 2024, for a Bounce & Roll Engine, is hereby incorporated by reference in its entirety.

Moakes, U.S. patent application Ser. No. 18/935,203, filed on Nov. 1, 2024 for a Reactive Game Play, is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A system for playing a virtual game with a fully scoreable outfield at a golf entertainment venue, the system comprising:

a plurality of golf ball tracking sensors positioned at a golf driving range of the golf entertainment venue;

a plurality of hitting bays at the golf driving range, each of the plurality of hitting bays having a video display; and a server in communication with each of the plurality of golf ball tracking sensors and each video display of the plurality of hitting bays;

wherein the server is configured to render a game on the video display, wherein the game comprises a virtual outfield composed of a plurality of tiles virtually representing an entire outfield of the golf driving range;

wherein at least one pair of the plurality of golf ball tracking sensors is configured to track a golf ball hit by a player in a hitting bay of the plurality of hitting bays;

wherein the server is configured to generate a trace of the golf ball in flight and a bounce and roll of the golf ball on the virtual outfield;

wherein the server is configured to determine which tiles of the plurality of tiles were virtually contacted by golf ball based on the trace of the golf ball in flight and the bounce and roll of the golf ball on the virtual outfield;

wherein the server is configured to award points to the player for virtually contacting tiles of the plurality of tiles.

2. The system according to claim 1 wherein the plurality of tiles comprises from 100 to 100,000 tiles.

3. The system according to claim 1 wherein the plurality of tiles comprises from 1000 to 50,000 tiles.

4. The system according to claim 1 wherein the plurality of tiles comprises from 10,000 to 20,000 tiles.

5. The system according to claim 1 wherein each tile is a hexagon.

6. The system according to claim 1 wherein each of the plurality of golf ball tracking sensors is a camera sensor.

7. The system according to claim 1 wherein each of the plurality of golf ball tracking sensors is a radar sensor.

8. The system according to claim 1 wherein each tile is a square, circle, diamond, triangle, rectangle or polygon.

9. The system according to claim 1 wherein each of the tiles is the same size.

10. The system according to claim 1 wherein each tile has a representative width ranging from 0.1 meter to 10 meters in the virtual outfield.

11. A method for playing a game with a fully scoreable outfield at a golf entertainment venue, the method comprising:

generating a game on a server for display on a video display in a hitting bay of a plurality of hitting bays of a golf driving range, wherein the game comprises a virtual outfield composed of a plurality of tiles virtually representing an entire outfield of the golf driving range;

hitting a golf ball toward the outfield of the golf driving range from the hitting bay of the plurality of hitting bays of the golf driving range;

tracking a flight of the golf ball using a plurality of golf ball tracking sensors positioned at a golf driving range;

communicating the data for the tracking of the golf ball from the plurality of golf ball tracking sensors to the server;

generating a bounce and roll prediction at the server for the tracked golf ball;

combining, at the server, a trace of the flight of the golf ball and the bounce and roll of the golf ball to generate a complete shot of the golf ball in the game;

displaying, on a video display in the hitting bay, the complete shot of the golf ball in the virtual outfield of the game;

determining which tiles of the plurality of tiles were virtually contacted by golf ball based on the complete shot of the golf ball on the virtual outfield; and awarding points to the player for tiles of the plurality tiles virtually contacted by the full shot of the golf ball in the virtual outfield of the game.

12. The method according to claim 11 wherein the plurality of tiles comprises from 100 to 100,000 tiles.

13. The method according to claim 11 wherein the plurality of tiles comprises from 1000 to 50,000 tiles.

14. The method according to claim 11 wherein the plurality of tiles comprises from 10,000 to 20,000 tiles.

15. The method according to claim 11 wherein each tile is a hexagon.

16. The method according to claim 11 wherein each of the plurality of golf ball tracking sensors is a camera sensor.

17. The method according to claim 11 wherein each of the plurality of golf ball tracking sensors is a radar sensor.

18. The method according to claim 11 wherein each tile is a square, circle, diamond, triangle, rectangle or polygon.

19. The method according to claim 11 wherein each of the tiles is the same size.

20. The method according to claim 11 wherein each tile has a representative width ranging from 0.1 meter to 10 meters in the virtual outfield.

* * * * *